US008607607B1

(12) United States Patent
Sanderson et al.

(10) Patent No.: US 8,607,607 B1
(45) Date of Patent: Dec. 17, 2013

(54) SYSTEM AND METHOD FOR FEEDING WIRE MATERIAL TO A ROTARY PRESS

(75) Inventors: Richard A. Sanderson, McKeesport, PA (US); Scott Brady, McKeesport, PA (US)

(73) Assignee: Elizabeth-Hata International, North Huntington, PA (US)

( * ) Notice: Subject to any disclaimer, the term of this patent is extended or adjusted under 35 U.S.C. 154(b) by 666 days.

(21) Appl. No.: 12/649,876

(22) Filed: Dec. 30, 2009

Related U.S. Application Data

(60) Provisional application No. 61/218,398, filed on Jun. 18, 2009.

(51) Int. Cl.
*B21F 11/00* (2006.01)

(52) U.S. Cl.
USPC ..... 72/130; 72/132; 72/405.03; 140/140; 83/112

(58) Field of Classification Search
USPC ..... 72/129, 130, 132, 324, 405.03; 470/129, 135, 153, 156, 164, 179; 140/139, 140; 425/305.1; 29/38 A, 36, 29/33 J; 83/112, 154
See application file for complete search history.

(56) References Cited

U.S. PATENT DOCUMENTS

| | | | | | |
|---|---|---|---|---|---|
| 2,727,473 | A | * | 12/1955 | Wolff et al. | 425/126.1 |
| 2,787,828 | A | * | 4/1957 | Cousino | 72/354.2 |
| 2,800,814 | A | * | 7/1957 | Lewis, Jr. | 72/339 |
| 2,929,289 | A | * | 3/1960 | Gorecki | 83/411.5 |
| 3,011,376 | A | * | 12/1961 | Wright et al. | 83/199 |
| 3,849,041 | A | * | 11/1974 | Knapp | 425/110 |
| 3,894,334 | A | * | 7/1975 | Bannister et al. | 29/879 |
| 4,044,640 | A | * | 8/1977 | Gokyu | 83/42 |
| 5,004,413 | A | | 4/1991 | Stopforth | |
| 5,081,732 | A | * | 1/1992 | Steinhilber | 470/129 |
| 5,761,779 | A | * | 6/1998 | Maruyama et al. | 29/899 |
| 6,116,889 | A | | 9/2000 | Pagel et al. | |
| 8,062,015 | B2 | * | 11/2011 | Sanderson | 425/126.1 |

* cited by examiner

*Primary Examiner* — Edward Tolan
(74) *Attorney, Agent, or Firm* — Middleton Reutlinger; Robert H. Eichenberger; Scott W. Higdon

(57) ABSTRACT

A system and a method for feeding wire material to a rotary compaction press are provided. In some embodiments the method includes the steps of feeding a wire strand of material to a location adjacent a cutting surface; moving the cutting surface, thereby causing the cutting surface to cut the wire strand of material into a wire pellet of material; and transporting the wire pellet of material to adjacent a die table of a rotary compaction press. In some embodiments the system includes a wire exit aperture. A cutting disc may be provided adjacent the wire exit aperture and may have a plurality of wire cutting surfaces and adjacent wire notches. The cutting disc may be rotatable, thereby causing the wire cutting surfaces to sequentially pass over the wire exit aperture.

21 Claims, 14 Drawing Sheets

SYSTEM AND METHOD FOR FEEDING WIRE MATERIAL TO A ROTARY PRESS

CROSS-REFERENCE TO RELATED DOCUMENTS

This Application claims the benefit of Provisional Application Ser. No. 61/218,398 filed Jun. 18, 2009, entitled System and Method for Feeding Wire Material to a Rotary Compaction Press, which is hereby incorporated by reference in its entirety.

TECHNICAL FIELD

This invention pertains generally to a wire feed system for a rotary press.

BACKGROUND

Rotary compaction presses may be employed in the compression of powders or granulates into a shaped solid form. For example, the powders or granulates may be fed into a plurality of die bores in a die table of the rotary compaction press. The powders or granulates may then be compressed between an upper punch and a lower punch into a shaped form, and subsequently discharged from the die bore. Often, a plurality of upper punches are provided, each axially aligned with one of a plurality of lower punches. Each of the upper punches and lower punches are seated within a corresponding punch guide and are moved axially within the punch guide by control cams. Such rotary compaction presses may be used, for example, in the pharmaceutical manufacturing industry for tablet manufacturing.

SUMMARY

Generally, in one aspect, a method for feeding material to a die table of a rotary compaction press includes the steps of feeding a wire strand of material to a location adjacent a cutting surface; moving the cutting surface, thereby causing the cutting surface to cut the wire strand of material into a wire pellet of material; transporting the wire pellet of material to a location adjacent the die table of the rotary compaction press; and placing the wire pellet of material into a die of the die table of the rotary compaction press.

In some embodiments the method may further comprise the step of feeding the wire strand of material through a coil spring prior to causing the cutting surface to cut the wire strand of material into a wire pellet of material. In some versions of those embodiments the method may further comprise the step of feeding the wire strand of material through a wire tractor feeder prior to feeding the wire strand of material through the coil spring.

In some embodiments the cutting surface is a single of a plurality of cutting surfaces. In some versions of those embodiments the plurality of cutting surfaces are annularly arranged on a cutting disc.

In some embodiments the cutting surface has an adjacent notch that transports the wire pellet of material to the location above the die table of the rotary compaction press. In some versions of those embodiments the method may further comprise the step of compressing the wire pellet of material in the die after placing the wire pellet of material into the die.

In some embodiments the method may further comprise the step of adjusting a wire stop adjacent the location adjacent the cutting surface to thereby alter a size of the wire pellet of material.

Generally, in another aspect, a method for feeding material to a die table of a rotary compaction press includes the steps of feeding a wire strand of material to a cutting disc having a plurality of annularly arranged cutting surfaces, with each of the cutting surfaces having an adjacent notch; rotating the cutting disc, thereby causing the cutting surface to cut the wire strand of material into a wire pellet of material and maintain the wire pellet of material in the notch; and discharging the wire pellet of material from the notch of the rotating cutting disc.

In some embodiments the method may further comprise the step of feeding the wire strand of material through a coil spring prior to causing the cutting surface to cut the wire strand of material into a wire pellet of material.

In some embodiments the cutting surfaces are arranged along the periphery of the cutting disc.

In some embodiments the method may further comprise the step of actuating a tamp having a tamping area, the tamping area contacting the wire pellet of material in the notch, thereby discharging the wire pellet of material from the notch of the rotating cutting disc.

Generally, in another aspect a wire feed system for a rotary compaction press includes a wire block having a wire exit aperture. A cutting disc is provided adjacent the wire exit aperture of the wire block. The cutting disc has a plurality of annularly arranged wire cutting surfaces and adjacent wire notches. The cutting disc is rotatable, thereby causing the wire cutting surfaces to sequentially pass over the wire exit aperture. A tamp area is provided and is selectively aligned with the wire notches. The tamp area is actuable, movable from a first position adjacent the cutting disc and a single of the notches when a single of the notches passes thereby to a second position more distal the cutting disc than the first position.

In some embodiments the system further comprises a coil spring coupled between the wire block and a wire feeder structure and the interior of the coil spring is in communication with the wire exit aperture of the wire block. The wire feeder structure may be, for example, a wire tractor feeder or slip rolls.

In some embodiments the system further comprises a plurality of tamp cams on the cutting disc, wherein each of the tamp cams causes the tamp area to move from the first position toward the second position.

In some embodiments the system further comprises a wire stop coaxially aligned with the wire exit aperture of the wire block. In some versions of those embodiments the wire stop is provided on a substantially opposite side of the cutting disc than the wire exit aperture. In some versions of those embodiments the wire stop is selectively axially adjustable, thereby altering the distance between the wire exit aperture and the wire stop. The wire stop may optionally be automatically selectively axially adjustable.

In some embodiments the notches and the cutting surfaces are positioned along the periphery of the cutting disc.

Generally, in another aspect a wire feed system for a rotary compaction press includes a wire exit aperture. A cutting disc is provided adjacent the wire exit aperture, the cutting disc has a plurality of annularly arranged wire cutting surfaces and adjacent wire notches. The cutting disc is rotatable, thereby causing the wire cutting surfaces to sequentially pass over the wire exit aperture. A rotating die table is also provided having a plurality of dies below the cutting disc, wherein one of the plurality of dies is selectively coaxially aligned with one of the notches of the cutting disc. The system has a wire pellet placement location wherein one of the notches of the cutting disc and one of the dies of the die table are selectively correspondingly coaxially aligned with one another.

In some embodiments the system further comprises a tamp above the cutting disc and the tamp has a tamping area selectively correspondingly aligned with one of the notches of the cutting disc and one of the plurality of dies of the die table at the wire pellet placement location. In some versions of these embodiments the tamp area is actuable, movable from a first position adjacent the cutting disc and one of the notches when one of the notches passes thereby and is coaxially aligned with one of the dies to a second position more distal the cutting disc than the first position.

In some embodiments the system further comprises a coil spring coupled between the wire block and a wire feeder structure.

In some embodiments the system further comprises a wire stop coaxially aligned with the wire exit aperture of the wire block. In some versions of those embodiments the wire stop is selectively axially adjustable, thereby altering the distance between the wire exit aperture and the wire stop. The wire stop may optionally be automatically selectively axially adjustable.

In some embodiments the notches and the cutting surfaces are positioned along the periphery of the cutting disc.

BRIEF DESCRIPTION OF THE ILLUSTRATIONS

The above-mentioned and other features and advantages of this invention, and the manner of attaining them, will become more apparent and the invention will be better understood by reference to the following description of embodiments of the invention taken in conjunction with the accompanying drawings, wherein.

DETAILED DESCRIPTION

Figure 1:
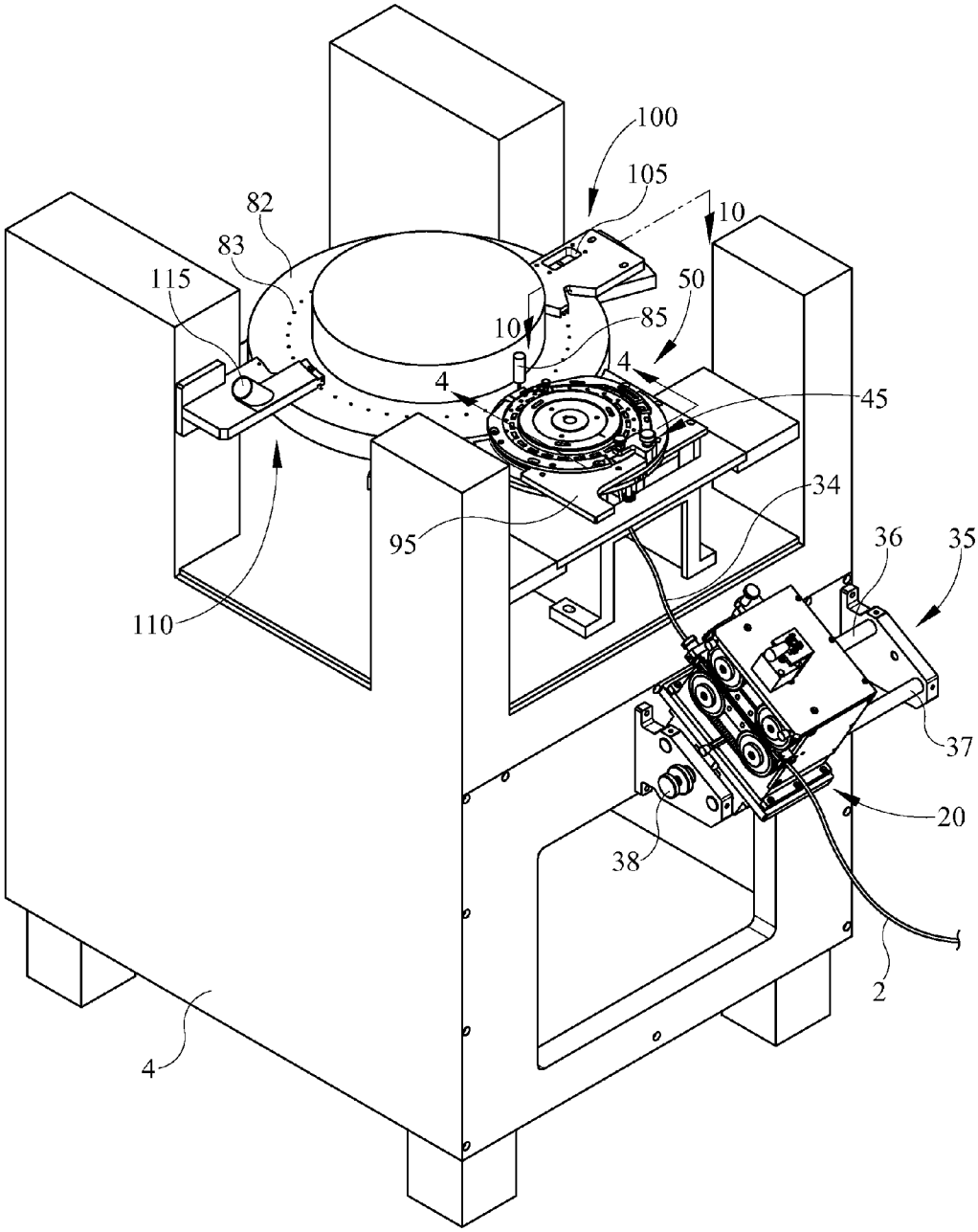
FIG. 1 is a top perspective view of an embodiment of a system for feeding wire material to a rotary compaction press shown adjacent to a die table of a rotary compaction press.

It is to be understood that the invention is not limited in its application to the details of construction and the arrangement of components set forth in the following description or illustrated in the drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," "in communication with" and "mounted," and variations thereof herein are used broadly and encompass direct and indirect connections, couplings, and mountings. In addition, the terms "connected" and "coupled" and variations thereof are not restricted to physical or mechanical connections or couplings.

Furthermore, and as described in subsequent paragraphs, the specific mechanical configurations illustrated in the drawings are intended to exemplify embodiments of the invention and that other alternative mechanical configurations are possible.

Referring now to FIGS. 1 through 12, wherein like numerals refer to like parts, various aspects of a system and method for feeding wire material to a rotary compaction press are shown. The system for feeding wire material to a rotary compaction press feeds individual wire pellets 3 cut from a wire strand of material 2 to a rotary compaction press, where the wire pellets 3 may be compacted and/or formed into a desired shape. In some embodiments the wire strand of material 2 may be a wire strand of malleable material such as, for example, lead or a tungsten-polymer composite material available from Tundra Particle technologies. In some embodiments the system for feeding wire material to a rotary compaction press may also contain one or more vacuums adjacent the rotary compaction press for removing debris or unwanted wire pellets from the rotary compaction press and/or for removing formed wire pellets from the rotary compaction press.

Figure 8:
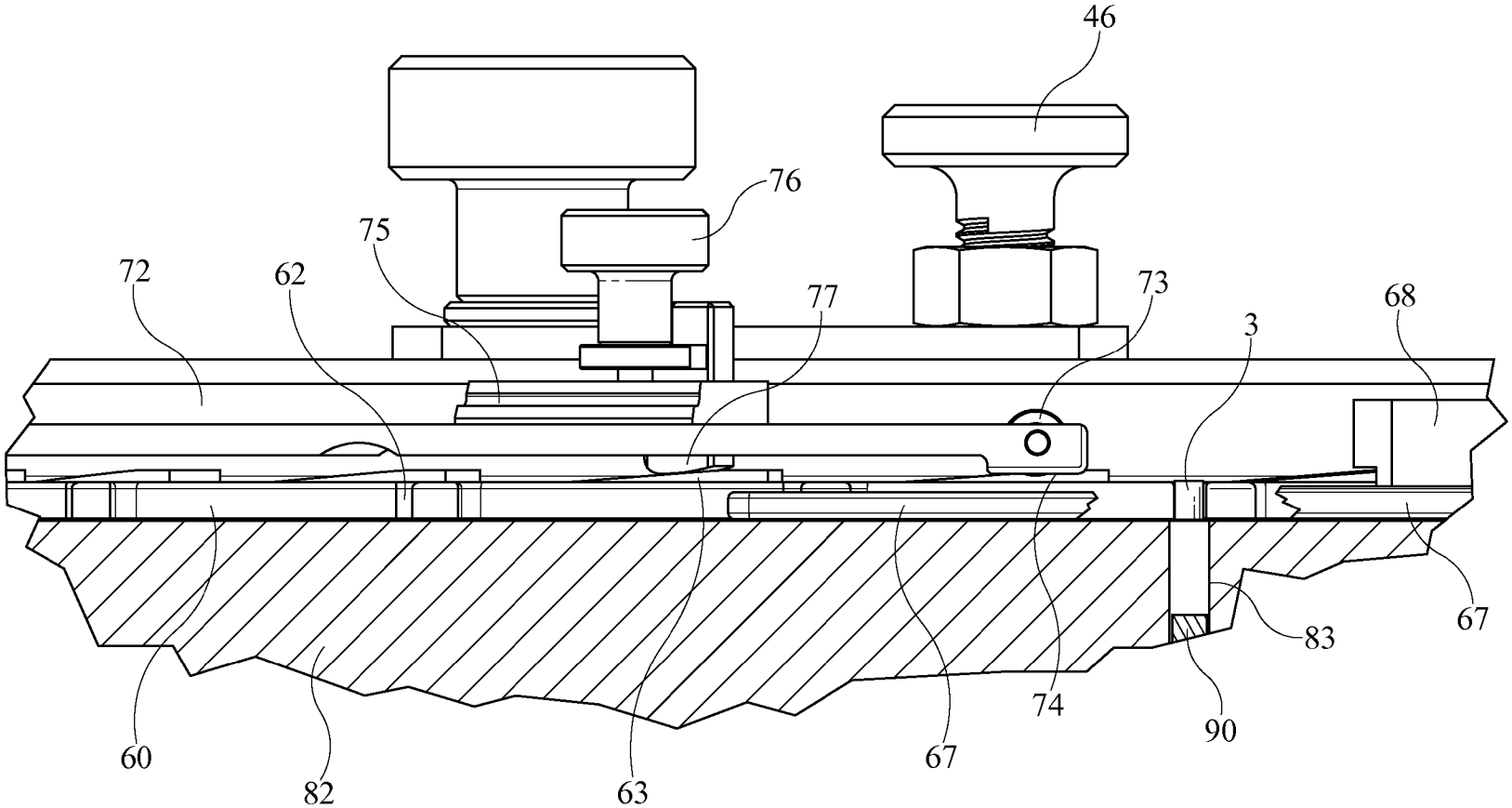
FIG. 8 is a side view of a portion of the embodiment of the system for feeding wire material to a rotary compaction press of FIG. 1 showing a wire pellet prior to being placed in a die of a die table, with the die table sectioned in the middle of the die and a portion of the post-shear pellet guide broken away.
Figure 9:
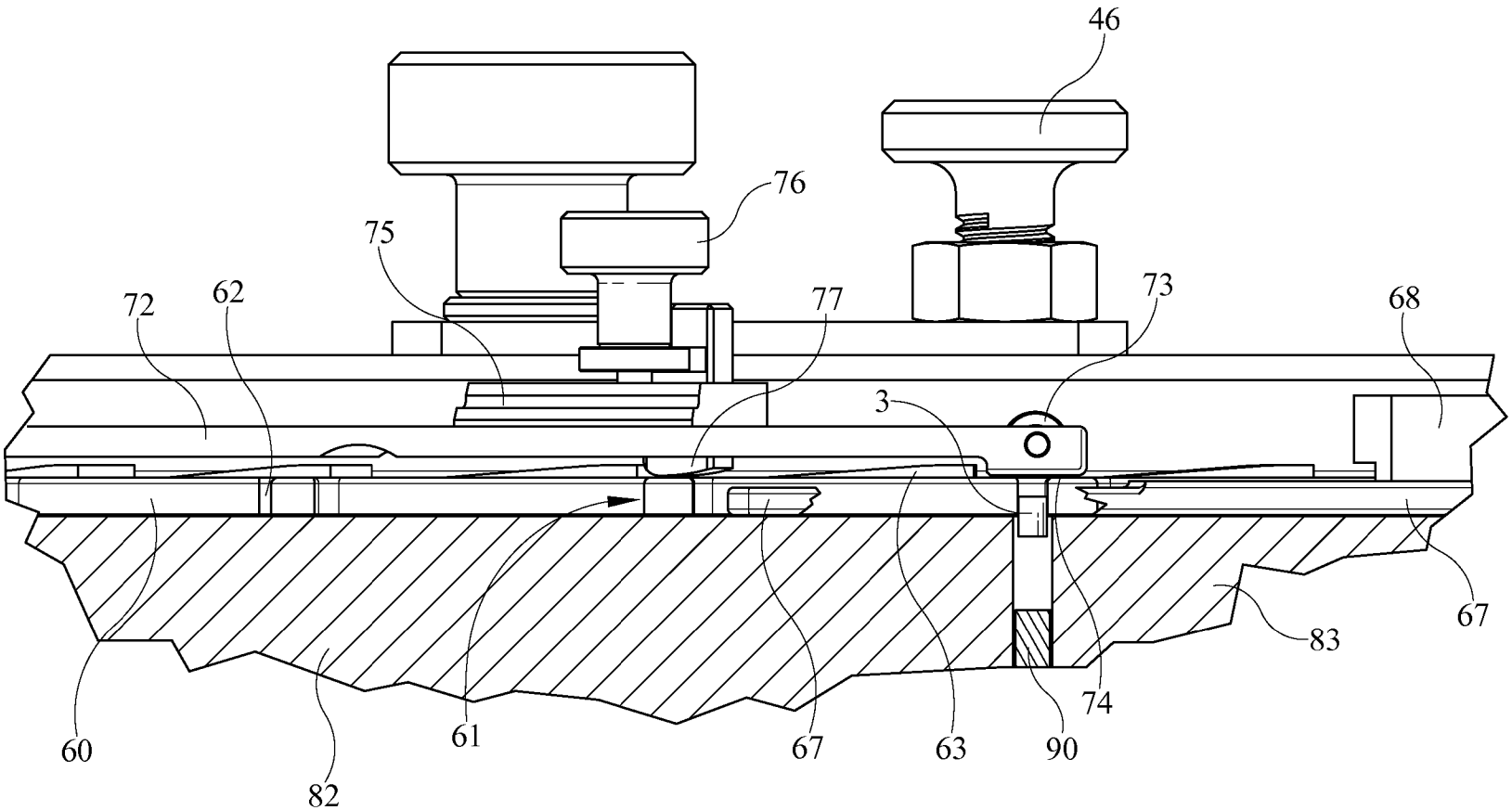
FIG. 9 is a side view of a portion of the embodiment of the system for feeding wire material to a rotary compaction press of FIG. 1 showing a wire pellet as it is being placed in a die of a die table, with the die table sectioned in the middle of the die and a portion of the post-shear pellet guide broken away.

Referring initially to FIG. 1, an embodiment of a system for feeding wire material to a rotary compaction press is shown adjacent to a die table 82 of a rotary compaction press. The die table 82 of a rotary compaction press is shown in FIG. 1, and in FIGS. 7 through 12, and will be described in detail herein for ease in understanding the system and method for feeding wire material to a rotary compaction press. The rotary compaction press may include other component parts, such as, for example, upper punches 85, an upper cam track, lower punches 90, and/or a lower cam track. Many of these component parts are described herein and illustrated in certain of FIGS. 1 through 12, for ease in understanding the system for feeding wire material to a rotary compaction press. For example, upper punches 85 are illustrated in FIG. 1, FIG. 2, FIG. 11, and FIG. 12 and lower punches 90 are illustrated in FIGS. 8 and 9.

With continuing reference to FIG. 1, a wire strand of material 2 may be fed to a wire tractor feeder 20. The wire tractor feeder 20 may feed the wire strand of material 2 through a flexible close wound spring 34 to adjacent a wire strand cutting and wire pellet transporting assembly 50. The wire strand cutting and wire pellet transporting assembly 50 may shear the strand of wire into individual wire pellets and transport the individual wire pellets 3 to adjacent the die table 82, where each of the individual wire pellets 3 may be placed into an individual die 83 of the die table 82. After an individual wire pellet 3 has been placed into a die 83, it may then be compressed within the die 83 by an upper punch 85 and/or a lower punch 90 and formed into a desired shape. In some applications, a plurality of upper punches 85 and lower punches 90 may be provided on the rotary compaction press. The upper punches 85 and lower punches 90 may ride on a cam track and each wire pellet 3 may be compressed within the die 83 between the tip of an upper punch 85 and the tip of a lower punch 90 subsequent to the wire pellet 3 being inserted in the die. Subsequent to the wire pellet 3 being compressed between the tip of the upper punch 85 and the tip of the lower punch 90, the upper punch 85 and/or lower punch 90 may be removed from the die and the compressed wire pellet 3 removed from the die as well.

Figure 2:
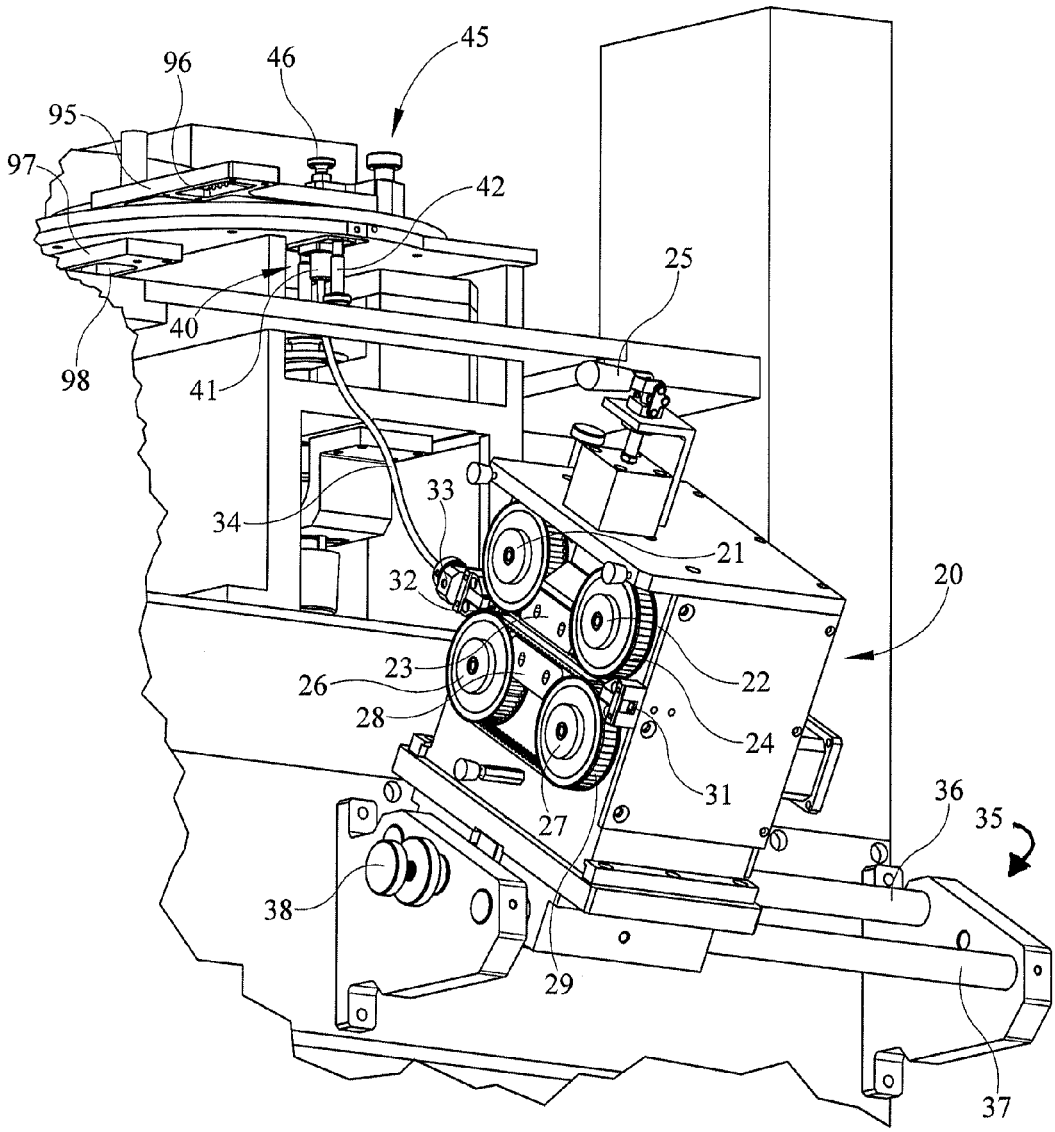
FIG. 2 is a bottom perspective view of portions of the embodiment of a system for feeding wire material to a rotary compaction press of FIG. 1.
Figure 3:
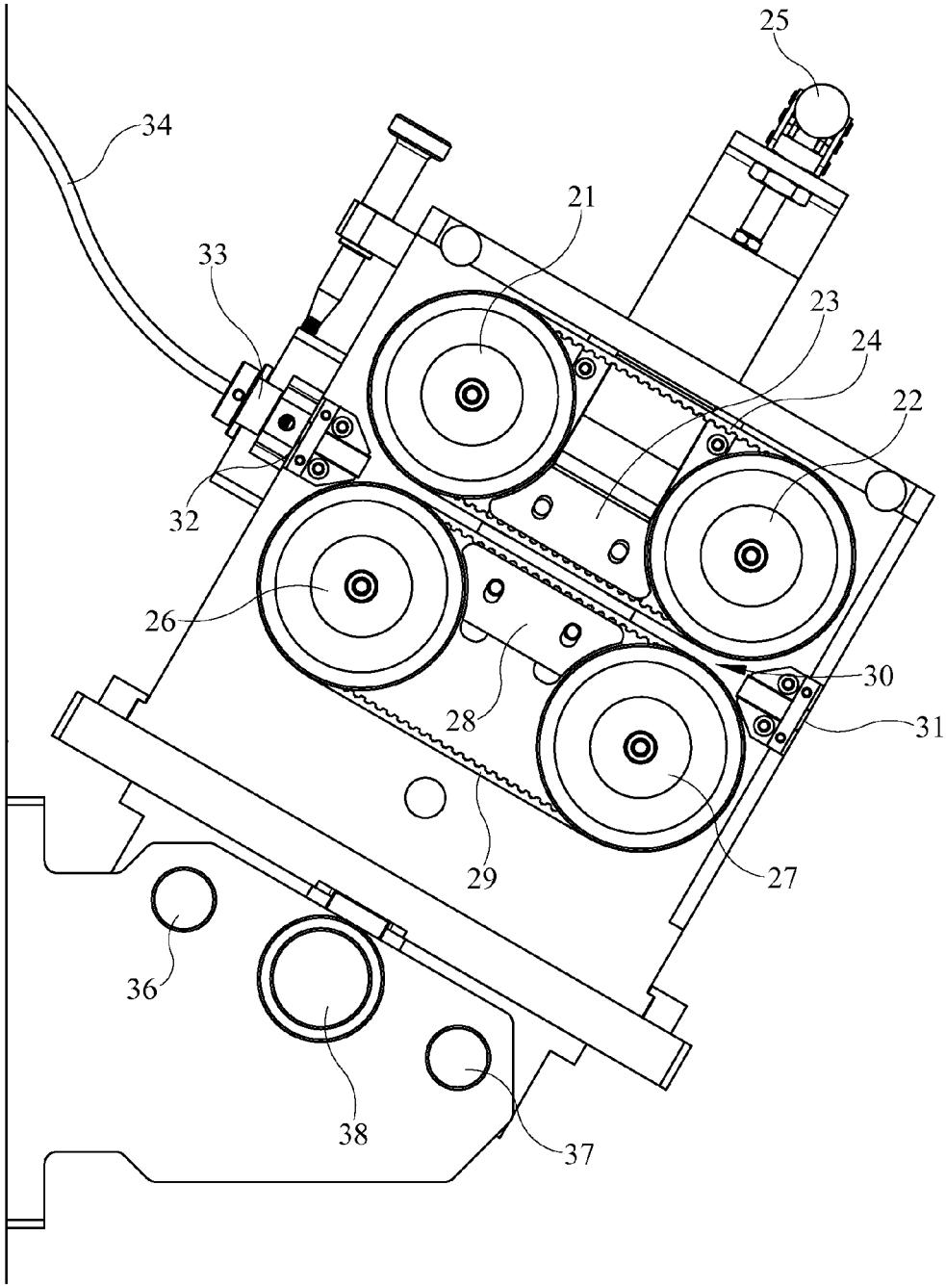
FIG. 3 is a side view of a wire tractor feeder, a spring funnel piece, and a close wound spring of the embodiment of a system for feeding wire material to a rotary compaction press of FIG. 1.

Referring now to FIGS. 2 and 3, the depicted embodiment of the wire tractor feeder 20 is described in more detail. The wire tractor feeder 20 has an upper left cog 21 and an upper right cog 22 driving an upper cog belt 24 in a clockwise rotation as viewed from the left side, as in FIG. 3. A pressure pad 23 is provided between the upper left cog 21 and the upper right cog 22 and contacts the upper cog belt 24. The wire tractor feeder 20 also has a lower left cog 26 and a lower right cog 27 driving a lower cog belt 29 in a counter-clockwise rotation as viewed from the left side, as in FIG. 3. A pressure pad 28 is provided between the lower left cog 26 and the lower right cog 27 and contacts the lower cog belt 29. A wire passageway 30 extends between the upper cog belt 24 and the lower cog belt 29 and is in communication with a wire entrance aperture 31 and a wire exit aperture 32 of the wire tractor feeder 20.

A wire strand of material 2 may be fed into wire tractor feeder 20 through wire entrance aperture 31, extend through wire passageway 30, and fed out of wire tractor feeder 20 through wire exit aperture 32. The wire strand of material 2 may be guided through the wire passageway 30 of the wire tractor feeder 20 between the upper cog belt 24 and the lower cog belt 29. The amount of pressure applied to the wire strand of material 2 may be adjusted by a user via pneumatic handle 25. Pneumatic handle 25 may be coupled to a pneumatic cylinder that adjusts the location of pressure pad 23, moving it closer to or farther away from pressure pad 26 and thereby adjusting the distance between upper cog belt 24 and lower cog belt 29. The wire tractor feeder 20 may be driven by a motor such as, for example, a constant speed motor, a variable speed motor, a stepper motor, or a servo motor. Moreover, one or more electronic controllers may be utilized in conjunction with a motor to selectively drive the wire tractor feeder 20 and/or to drive the wire tractor feeder 20 at various speeds. In some embodiments a servo motor may drive the tractor feeder 20 and a PLC may be utilized to selectively drive the servo motor and/or to drive the servo motor at various speeds.

The term "controller" is used herein generally to describe various apparatus relating to the operation of one or more components described herein. A "processor" is one example of a controller which employs one or more microprocessors that may be programmed using software (e.g., microcode) to perform various functions discussed herein. A controller may be implemented with or without employing a processor, and also may be implemented as a combination of dedicated hardware to perform some functions and a processor (e.g., one or more programmed microprocessors and associated circuitry) to perform other functions. Examples of controller components that may be employed in various embodiments of the present disclosure include, but are not limited to, conventional microprocessors, application specific integrated circuits (ASICs), and field-programmable gate arrays (FPGAs In some embodiments the wire tractor feeder 20 may be a Dual Belt Tractor Feed Linear Feed Unit available from TAK Enterprises. In some embodiments the wire tractor feeder 20 may pull the wire strand of material 2 from a spool of wire strand of material. In some embodiments a spool of wire strand of material may be coupled to a servo motor driven un-winder to help remove the wire strand of material from a spool. One or more electronic controllers may be in communication with the servo motor of the servo driven un-winder to selectively drive the servo driven un-winder and/or to drive the servo driven un-winder at various speeds. One or more electronic controllers may be in communication with the servo motor of the servo driven un-winder and with a servo motor driving the wire tractor feeder 20 to correspondingly selectively drive the wire tractor feeder 20 and the un-winder and/or to correspondingly drive the wire tractor feeder 20 and un-winder at a desired speed.

In alternative embodiments wire strand of material 2 may be alternatively fed to adjacent a wire strand cutting and wire pellet transporting assembly 50. For example, in some embodiments the wire strand of material 2 may be manually fed thereto. Also, for example, in some embodiments the wire strand of material 2 may be fed to the wire strand cutting and wire pellet transporting assembly 50 by slip rolls that contact the wire strand of material 2 with sufficient force to advance the wire strand of material 2. The slippage in the slip rolls may be controlled by, for example, a slip clutch between a drive motor and the slip rolls.

As will be appreciated by one of ordinary skill in the art having had the benefit of the present disclosure, in some embodiments, prior to reaching the wire strand cutting and wire pellet transporting assembly 50, the wire strand of material 2 may be heated to a temperature sufficient to substantially remove any memory from the material. Heating the wire strand of material 2 to a temperature sufficient to substantially remove any memory from the material may help a formed pellet retain its shape. In some embodiments an induction coil may be utilized to heat the wire strand of material to approximately sixty degrees Celsius prior to passing the wire strand of material through slip rolls. In some embodiments the slip rolls may be configured so as to minimize the contact area with the wire strand of material 2 and therefore minimize heat loss from the wire strand of material.

With continuing reference to FIG. 2 and FIG. 3, wire tractor feeder 20 is mounted to a slide rod assembly 35 that is coupled to a base 4, shown in FIG. 1. The slide rod assembly 35 has a first slide rod 36 and a second slide rod 37. Wire tractor feeder 20 may be adjusted along the length of first slide rod 36 and second slide rod 37. A slide stop knob 38 may be actuated by a user to selectively fix wire tractor feeder 20 at a desired location along the length of first slide rod 36 and second slide rod 37. A spring funnel piece 33 is in communication with wire exit aperture 32 of wire tractor feeder 20 and is in communication with the interior of close wound spring 34. The spring funnel piece 33 has an internal funnel with a funnel base that is adjacent to the wire exit aperture 32. The internal funnel tapers from the funnel base toward a spring tube connection area within spring funnel piece 33. Close wound spring 34 may be inserted into the spring tube connection area within spring funnel piece 33 placing the interior of the close wound spring 34 in communication with the wire exit aperture 32. The close wound spring 34 may be secured in place within the spring funnel piece 33 with a set screw. A strand of wire material 2 may then be fed through the wire exit aperture 32 of wire tractor feeder 20, into spring funnel piece 33, and into close wound spring 34.

Figure 4:
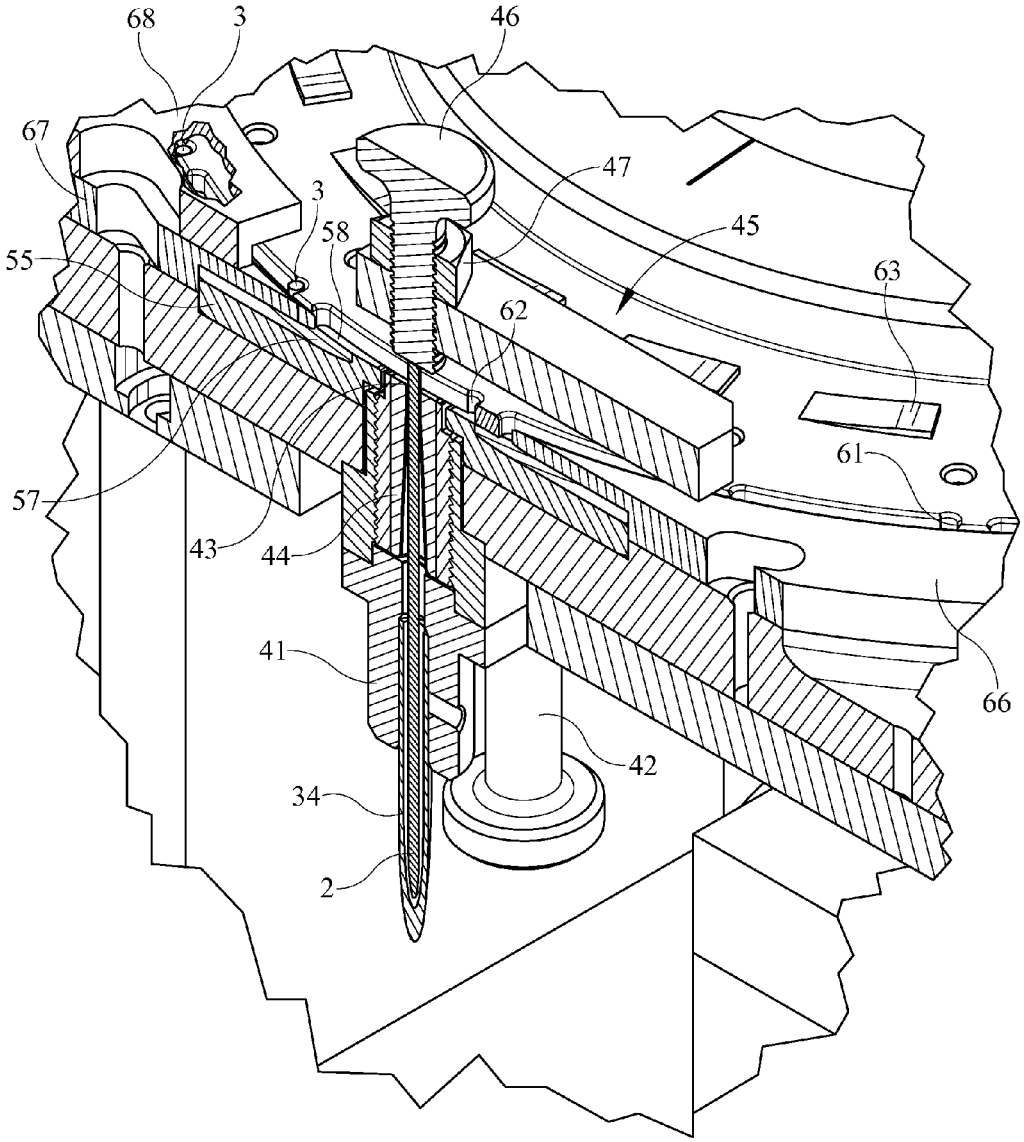
FIG. 4 is a section view of a portion of the embodiment of the system for feeding wire material to a rotary compaction press of FIG. 1, taken along the section line 4-4 of FIG. 1 and with a portion of a post-shear pellet guide broken away.
Figure 6:
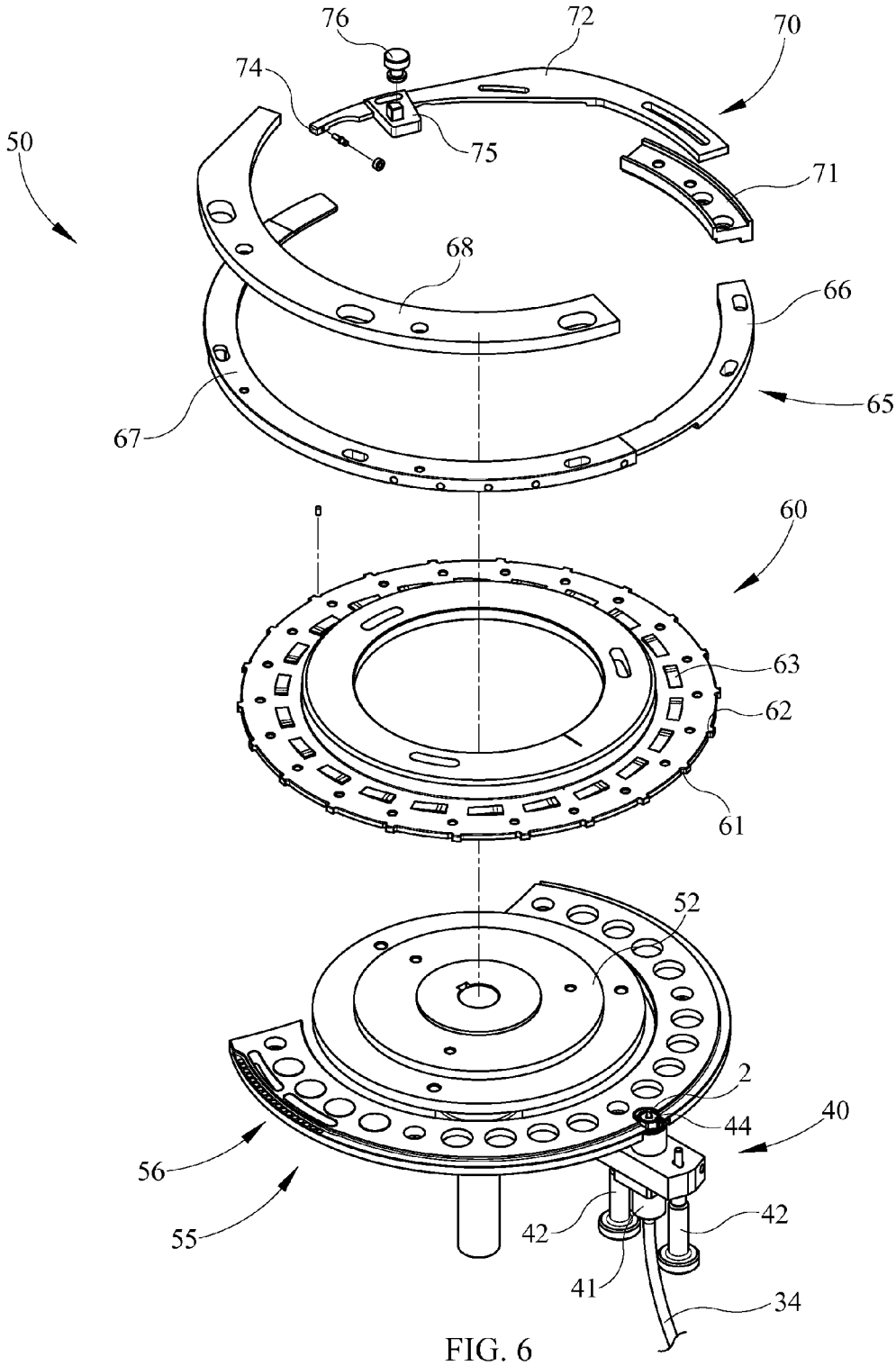
FIG. 6 is an exploded perspective view of the strand cutting and wire pellet transporting assembly and the wire block of the embodiment of the system for feeding wire material to a rotary compaction press of FIG. 1.
Figure 7:
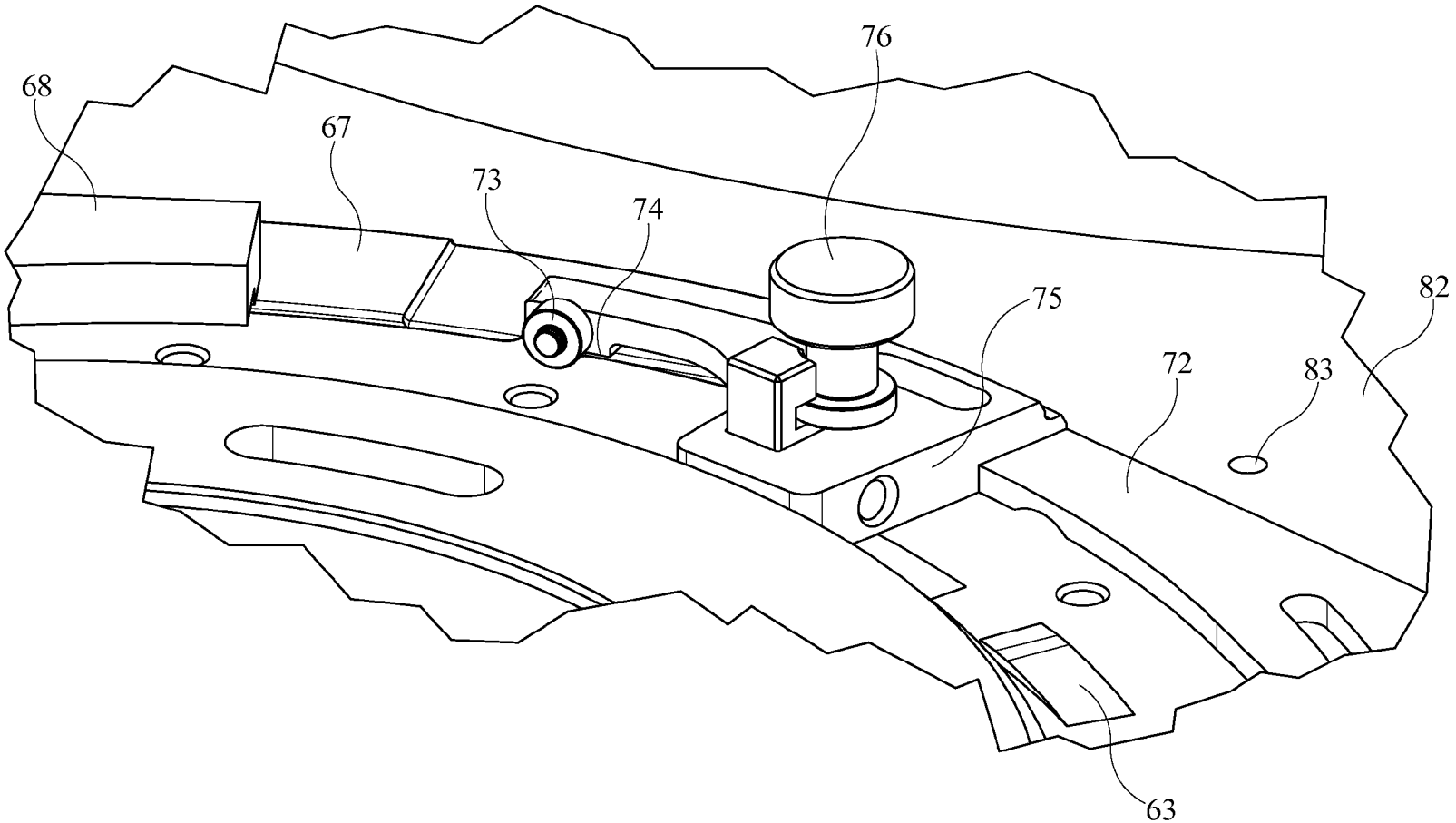
FIG. 7 is a top perspective view of a portion of the embodiment of the system for feeding wire material to a rotary compaction press of FIG. 1, showing portions of the cutting disc, tamp, and pellet guide.

Referring to FIG. 2, FIG. 4, and FIG. 6, the close wound spring 34 is also coupled to a tube holder 41 of a wire block 40. The tube holder 41 may receive close wound spring 34 and maintain close wound spring 34 therein with a set screw. The interior of close wound spring 34 is in communication with an interior passageway of tube holder 41. Tube holder 41 is coupled to a wire sleeve 44. Wire sleeve 44 has a tapered wire passageway formed therethrough that is in communication with the interior passageway of tube holder 41 and, resultantly, is in communication with the interior of close wound spring 34. A wire exit aperture 43 of tube holder 41 is located adjacent a cutting disc 60 and defines a strand of wire material insertion location. The wire exit aperture 43 is positioned and sized to allow for a strand of wire material 2 to exit therefrom and be sheared by a shearing or cutting surface 61 of the cutting disc 60. The depicted wire block 45 also includes two screws 42 for attachment of the wire block 45. Various sized wire sleeves 44 may be provided and interchanged by a user for compatibility with various sizes of strand of wire material 2.

Wire exit aperture 43 is axially aligned with a wire stop screw 46 of a wire stop block 45. Wire stop screw 46 may be axially adjusted to alter the distance between the tip of wire stop screw 46 and wire exit aperture 43. Wire stop screw 46 may be maintained in a desired position by tightening of wire stop screw nut 47. The wire stop screw 46 may be used to ensure a consistent length of the wire strand of material 2 is sheared by the cutting disc 60. As the wire strand of material 2 passes from the wire exit aperture 43 it may contact the tip of the wire stop screw 46 to limit the amount of the wire strand of material 2 that is allowed to exit from the wire exit aperture 43 prior to being sheared by the cutting surface 61. In some embodiments, when the wire strand of material 2 contacts the top of the wire stop screw 46, it may cause the leading edge of the wire strand of material 2 to momentarily stop while the wire tractor feeder 20 continues to feed the wire strand of material 2 through the close wound spring 34. The flexibility of the close wound spring 34 may absorb this excess of wire strand of material 2 and reduce the likelihood of any breakage of the wire strand of material 2.

In some embodiments a controller in communication with the rotary compaction press may monitor the compacting pressure when compacting wire pellets 3 within a die 83. The compacting pressure may vary according to the volume of wire pellet 3 material placed into the die 83. The wire stop screw 46 may be axially adjusted based on the compaction pressure to ensure an appropriate volume of wire pellet material is placed in the die. In some embodiments the wire stop screw 46 may be automatically adjustable to automatically vary the distance between the tip of wire stop screw 46 and wire exit aperture 43. The wire stop screw 46 may be automatically adjusted based on the compaction pressure to ensure an appropriate volume of material is placed in the die. For example, in some embodiments the wire stop screw may be an unthreaded wire stop and be axially adjustable by a pneumatic actuator. The pneumatic actuator may be in communication with an electronic controller that causes the pneumatic actuator to adjust the wire stop based on the measured compaction pressure.

In some embodiments the wire stop screw 46 may be omitted and the length of the wire pellets 3 sheared from the wire strand of material 2 may be controlled by the rate at which the wire strand of material 2 is fed through the aperture 43 and/or the amount of time the wire strand of material 2 is fed through aperture 43 between shearing passes.

Referring to FIGS. 4 through 7, the depicted embodiment of wire strand cutting and wire pellet transporting assembly 50 includes a cutting disc support 55, a cutting disc 60, a wire pellet guide 65, and a tamp 70. Cutting disc support 55 has a cutting disc support ridge 58 offset from a cutting disc support lower surface 57. When transporting assembly 50 is assembled and installed adjacent to die table 82, the two longitudinal ends of cutting disc support 55 may abut die table 82 and be generally co-planar with die table 82. The cutting disc support ridge 58 may provide a surface on which wire pellets 3 may ride after being formed at the insertion point and prior to being transferred to the die table 82 and inserted into a die 83 of the die table 82. A plurality of vacuum apertures 56 (shown in FIG. 6) are provided through a portion of cutting disc support 55. Vacuum apertures 56 are in communication with a lower vacuum 97 (shown in FIG. 2). A vacuum hose may be attached to a vacuum port 98 of lower vacuum 97 to create suction in lower vacuum 97 and resultantly create suction through vacuum apertures 56. The vacuum apertures 56 may help to remove debris that may be present along the periphery of the portion of cutting disc 60 passing thereby. Any wire pellets 3 present along the periphery of the portion of cutting disc 60 passing thereby will not be removed by the vacuum aperture 56 and lower vacuum 97, as they will be appropriately secured by cutting disc 60, disc support ridge 58, and the wire pellet guide 60.

Cutting disc 60 has a plurality of tamp cams 63 on a top surface thereof. A plurality of cutting surfaces 61 are provided along a periphery of cutting disc 60 and each of the cutting surfaces has an adjacent notch area 62. Twenty-two tamp cams 63, twenty-two cutting surfaces 61, and twenty-two notches 62 are provided in the depicted embodiment. In some embodiments the cutting disc 60 may be manufactured from pre-hardened steel that is subsequently nitrated to increase the hardness of the steel. A plurality of interchangeable cutting discs 60 may be provided to allow for compatibility with different sizes of strands of wire material 2. Although cutting disc 60 is depicted throughout the figures as one integrally formed piece, it is also contemplated, for example, that the cutting surfaces 61 and/or notches 62 be formed separately from the remainder of the cutting disc 60. The separately formed cutting surfaces 61 and/or notches 62 may be removably coupled to the remainder of cutting disc 60, allowing for replacement to extend the life of the disc and/or to allow for compatibility with different sizes of strands of wire material 2. The separately formed cutting surfaces 61 and/or notches 62 may be manufactured from a carbide material in some embodiments.

The wire pellet guide 65 has a pre-shear wire pellet guide section 66 and a post-shear wire pellet guide section 67. A hood portion 68 may be placed over post-shear wire pellet guide section 67. When transporting assembly 50 is assembled, an interior facing portion of the wire pellet guide 65 will be adjacent the outermost portions of cutting surfaces 61. Wire pellet guide 65, cutting surfaces 61, and notches 62 will help maintain any wire pellets 3 within notches 62 from the wire insertion point until individual wire pellets 3 are distributed into dies 83. Also, individual wire pellets 3 may sit atop cutting disc support 55, and then may be transferred to, and sit atop die table 82 prior to being placed into dies 83.

Figure 5:
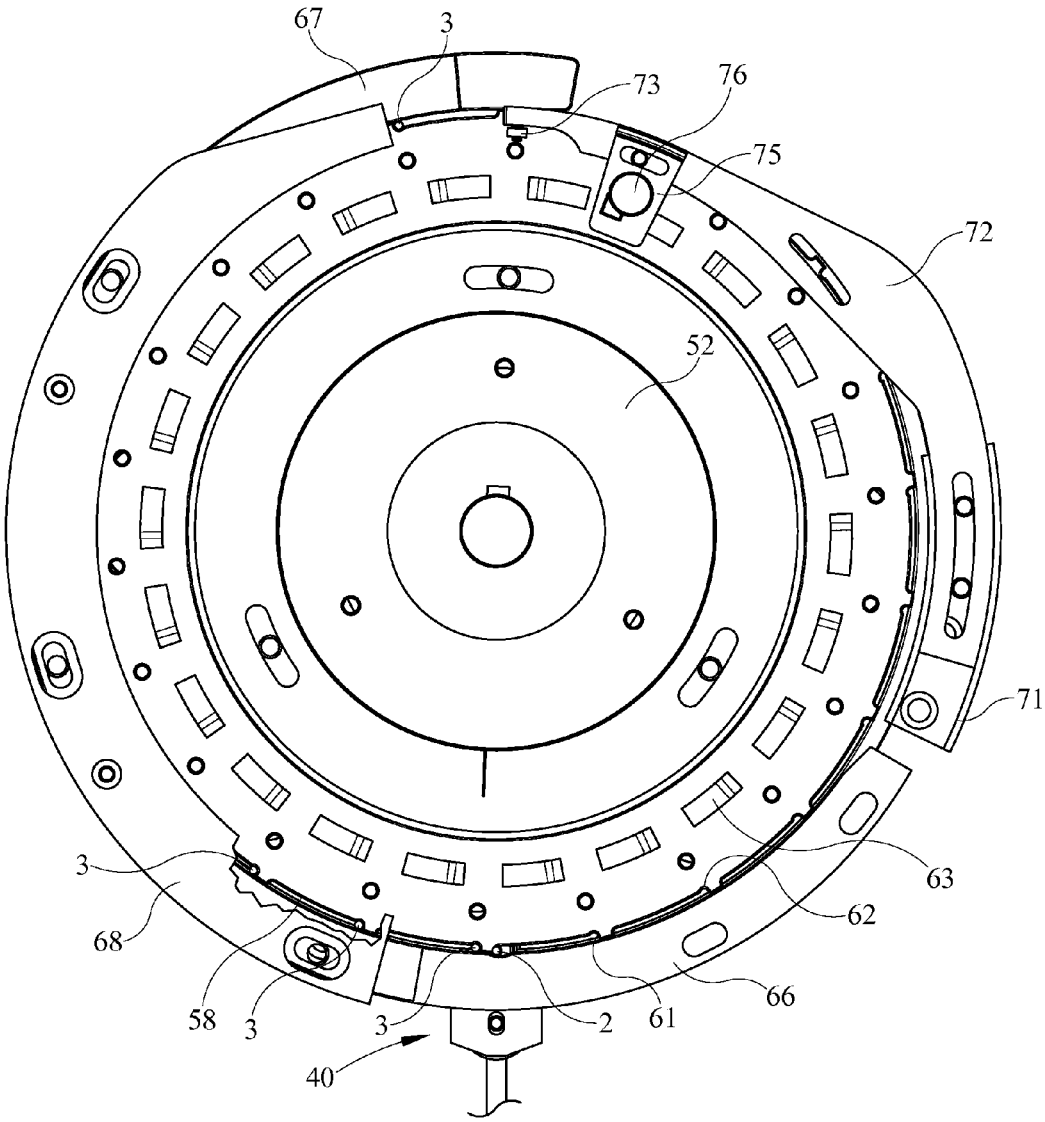
FIG. 5 is a top view of a strand cutting and wire pellet transporting assembly and a wire block of the embodiment of the system for feeding wire material to a rotary compaction press of FIG. 1, with a portion of the post-shear pellet guide broken away.

Hood portion 68 may be placed atop post-shear wire pellet guide section 67 and will extend over top of cutting surfaces 61 and notches 62 as they pass thereby. A portion of the hood portion 68 is shown broken away in FIGS. 4 and 5, showing individual wire pellets 3 being transported within notches 62 beneath hood portion 68. The hood portion 68 of post-shear wire pellet guide section 67 may help maintain individual wire pellets 3 in position. The hood portion 68 may also help prevent any objects from reaching any wire pellets 3 while they are adjacent post-shear wire pellet guide section 67. For example, in some embodiments a cleaning brush may be placed atop the cutting disc 60 adjacent the post-shear wire pellet guide section 67 and may contact a portion of the cutting disc 60. The brush may be connected to a vacuum system and may help remove any debris from tamp cams 63 and the top surface of cutting disc 60. The hood portion 68 atop the post-shear wire pellet guide section 67 may help prevent the brush from contacting any wire pellets 3 located below the hood portion 68.

The tamper 70 has a tamp arm mount 71 and a tamp arm 72 coupled to the tamp arm mount 71. A lift block 75 is coupled to the tamp arm 72 and has a lift block knob 76. A tamp arm roller 73 is coupled to the tamp arm adjacent a tamping area 74 may ride on top of the cutting disc 60. The tamping area 74 generally defines a wire pellet placement point. When transporting assembly 50 is assembled and installed adjacent to die press table 82, tamping area 74 will be located above the die press table 82. As will be described in more detail herein, as cutting disc 60 rotates, tamp cams 63 will sequentially contact a tamp cam protrusion on the bottom surface of the lift block 75, causing tamping area 74 to be sequentially raised and lowered. The tamping area 74 will be lowered when it is substantially axially aligned with a notch 62 of wire disc 60 and the notch 62 is substantially aligned with a die 83 of die table 82. The tamp arm 72 may be adjusted radially at the attachment between the tamp arm 72 and the tamp arm mount 71, moving the tamp area 74 in a clockwise or counterclockwise position as viewed from the top view of FIG. 5. Radial adjustment of the tamp arm 72 may help appropriately position the tamp area 74 and may adjust the timing of the raising and lowering of the tamp area 74. In some embodiments the tamp arm 72 may be hingedly coupled to structure to enable movement of tamp area 74. In some embodiments the tamp arm 72 may be fixedly coupled to structure and tamp arm 72 may act as a spring to enable movement of tamp area 74.

Cutting disc 60 may be coupled to a cutting disc drive 52 that rotates cutting disc 60. Cutting disc support 55 and wire pellet guide 65 may remain stationary during rotation of cutting disc 60. Tamper 70 will be raised and lowered by tamp cams 63, but remain otherwise stationary during rotation of cutting disc 60. In some embodiments the cutting disc drive 52 may be driven by a gear drive. In some embodiments the cutting disc drive 52 may be driven by a servo motor. Driving cutting disc drive 52 with a servo drive motor may allow programmable ratio changes, allow electronic timing adjustment of rotational speed of the cutting disc drive 52, and allow rotational positioning adjustment of the cutting disc 60 relative to the die table 82. The servo drive motor may be in electrical communication with an electronic controller that may cause the servo motor to stop or may cause the speed of the servo motor to be adjusted based on status or speed of one or more other components such as, for example, the wire tractor feeder 20 and/or the die table 82.

In the depicted embodiment cutting disc drive 52 rotates cutting disc 60 in a clockwise position when viewed from the top as in FIG. 5. In the depicted embodiment the die table 82 rotates in a counterclockwise position opposite the direction of cutting disc 60. In some embodiments all or portions of the wire strand cutting and wire pellet transporting assembly 50 may be mounted on a adjustable slide. The slide may, for example, allow positioning of the cutting disc 60 relative to the die table 82 to help position the notches 62 of cutting disc 60 in line with the dies 83 of die table 82 at the wire pellet placement point generally defined by tamping area 74. In some embodiments the adjustable slide may be a micrometer adjustable slide and/or may be adjustable while the wire pellet transporting assembly 50 is rotating.

In operation, the cutting disc 60 rotates causing cutting surfaces 61 to sequentially pass over the wire exit aperture 43. A strand of wire material 2 is fed through the wire exit aperture 43, causing a portion of the strand of wire material to be protruding therefrom when each cutting surface 61 passes over the wire exit aperture 43. The cutting surfaces 61 shear the portion of the strand of wire material 2 protruding from the wire exit aperture 43, creating individual wire pellets 3. The individual wire pellets 3 are then transferred into and maintained in notches 63 as the cutting disc 60 continues to rotate. The cutting disc 60 transports the wire pellets 3 to the die table 82, where wire pellets 3 are sequentially placed into individual dies 83 of the die table 82 at the wire pellet placement point generally defined by tamping area 74. When an individual pellet 3 reaches the wire pellet placement point, the wire pellet 3, and the notch 62 within which it is maintained, are generally aligned with an individual die 83.

The spacing of cutting surfaces 61 and notches 62 on cutting disc 60 may be related to the spacing of dies 83 on the die table 82. For example, the arc length between each of notches 62 may be approximately equal to the arc length between each of the dies 83 on the die table 82, allowing the die table 82 and cutting disc 60 to be rotated at the same speed while ensuring each notch 62 will be generally axially aligned with a die 83 when located at the insertion point. The number of cutting surfaces 61 and notches 62 on cutting disc 60 may also be related to the number of dies 83 on the die table 82. For example, in the depicted embodiment twenty-two cutting surfaces 61 and notches 62 are provided and forty-four dies 83 are provided on die table 82. In some embodiments, for example, forty-four cutting surfaces 61 and notches 62 may be provided and forty-four dies 83 may be provided on die table 82.

In some embodiments a cleaning brush may also be placed atop the cutting disc 60 at a location after the wire pellet placement point and before the strand of wire insertion point and may contact a portion of the cutting disc 60 to help remove debris therefrom. The brush may be connected to a vacuum system.

Referring to FIGS. 8 and 9, the wire pellet placement point is shown in additional detail and the tamp 70 and its operation are described in additional detail. In FIGS. 8 and 9 the cutting disc 60 and the die table 82 are moving from right to left. In FIG. 8, a portion of the post-shear pellet guide 67 is broken away showing an individual wire pellet 3 located to the right and before the tamp area 74. The die table 82 is sectioned midway through an individual die 83, showing the individual die 83, with the tip of a lower punch 90 provided at the base of the die 83. The individual die 83 shown in FIG. 8 is horizontally aligned with the wire pellet 3 and corresponding notch 62, but not axially aligned with the wire pellet 3. In other words, when viewing FIG. 8, the individual die 83 shown is closer to the viewer than the individual wire pellet 3. Tamp cam protrusion 77 on the base of tamp cam block 75 is shown contacting tamp cam 63, causing tamp area 74 to rise above wire pellet 3.

In FIG. 9, the cutting disc 60 and the die table 82 have both rotated farther to the left. A portion of the post-shear pellet guide 67 is also broken away in FIG. 9 and the die table 82 is sectioned midway through the same individual die 83 as shown in FIG. 8. The individual die 83 has now moved farther away from the viewer than in FIG. 8 and is now substantially horizontally and axially aligned with the individual wire pellet 3 and corresponding notch 62. The individual wire pellet 3 is located below the tamp area 74 and falling into the die 83. Tamp cam protrusion 77 on the base of tamp cam block 75 is shown just past a tamp cam 63, allowing tamp area 74 to fall toward the cutting disc 60 as shown. Tamp area 74 may have contacted wire pellet 3 as it fell, or prior to it falling, to help place wire pellet 3 into die 83.

In some embodiments, when a wire pellet 3 is inserted into a die 83 at the placement point, the corresponding lower punch 90 may be lowered so that the tip of the lower punch 90 is at its lowest point within the die 83 to ensure enough room is available in the die 83 for the die 83 to receive the wire pellet 83. With reference to FIG. 1, after a wire pellet 3 has been inserted into a die 83 of die table 82, the die table 82 will continue to rotate counterclockwise, moving the inserted wire pellets 3 toward a die table vacuum assembly 100. In some embodiments upper punches 85 may contact a cam track that moves the tips of the upper punches 85 into the dies 83 after a wire pellet 3 has been inserted at the insertion point and prior to the wire pellet 3 reaching the die table vacuum assembly 100. Moving the tips of the upper punches 85 into the dies 83 after a wire pellet 3 has been inserted may ensure the wire pellet 3 is firmly seated in the dies 83 and/or may provide pre-compression of the wire pellets 3. The upper punches 85 may be raised by a cam prior to reaching the die table vacuum assembly 100 to prevent them from contacting the die table vacuum assembly 100.

Figure 10:
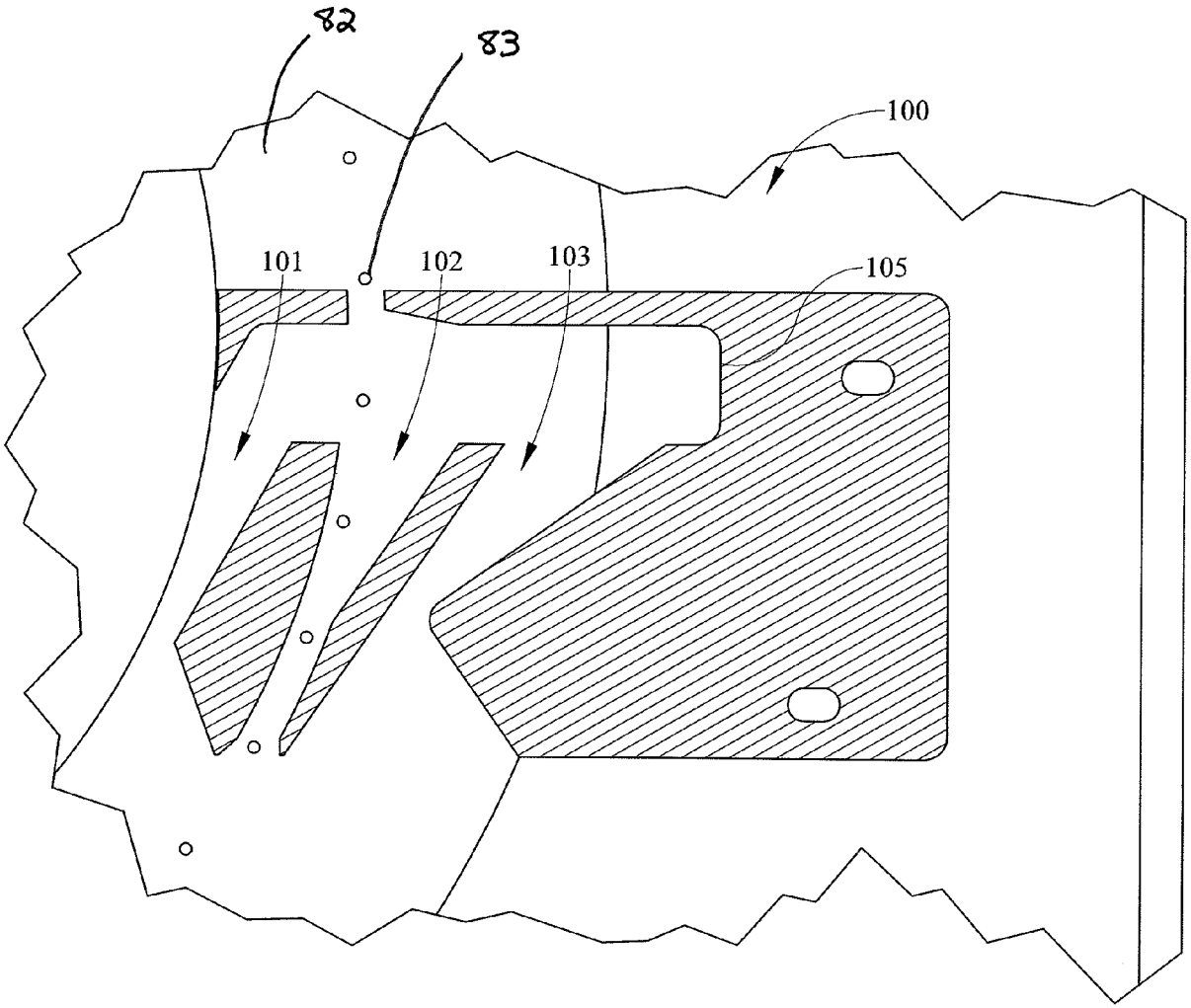
FIG. 10 is a top section view of a portion of the embodiment of the system for feeding wire material to a rotary compaction press of FIG. 1 taken along the section line 10-10 of FIG. 1 and showing a die table vacuum assembly atop a die table.

Referring to FIG. 10, die table vacuum assembly 100 is divided into three separate chambers and has a first die table vacuum port 105 in communication with all three chambers. A first die table vacuum assembly chamber 101 is located interiorly of the dies 83, a second die table vacuum assembly chamber 102 is located over the dies 83, and a third die table vacuum assembly chamber 103 is located exteriorly of the dies 83. A vacuum tube may be couple to the first die table vacuum port 105, creating suction in all three chamber 101, 102, and 103. The suction at first die table vacuum assembly chamber 101 will help remove any debris located interiorly of dies 83 as the die table 82 rotates. The suction at third die table vacuum assembly chamber 103 will help remove any debris located exteriorly of dies 83 as the die table 82 rotates. The suction at second die table vacuum assembly chamber 102 will help remove any debris located in or around dies 83 as the die table 82 rotates. The suction at second die table vacuum assembly chamber 102 should not be to great so as to cause any wire pellets 3 that should be maintained within dies 83 to removed therefrom.

In some embodiments the second die table vacuum assembly chamber 102 may be provided as a separate chamber not in communication with either of first die table vacuum assembly chamber 101 or third die table vacuum assembly chamber 103. In some embodiments one or more butterfly valves may be implemented to alter the vacuum between vacuum assembly chambers 101, 102, and 103. In some embodiments the second die table vacuum assembly chamber 102 may be provided with a separate vacuum port, thereby allowing the amount of vacuum present at second die table vacuum assembly chamber 102 to be different from the amount of vacuum present at first die table vacuum assembly chamber 101 and third die table vacuum assembly chamber 103. Such an arrangement may allow a stronger vacuum at first die table vacuum assembly chamber 101 and third die table vacuum assembly chamber 103, without fear of creating too great of a vacuum in second die table vacuum assembly chamber 102 that may remove wire pellets 3 that should be maintained within dies 83.

Figure 13:
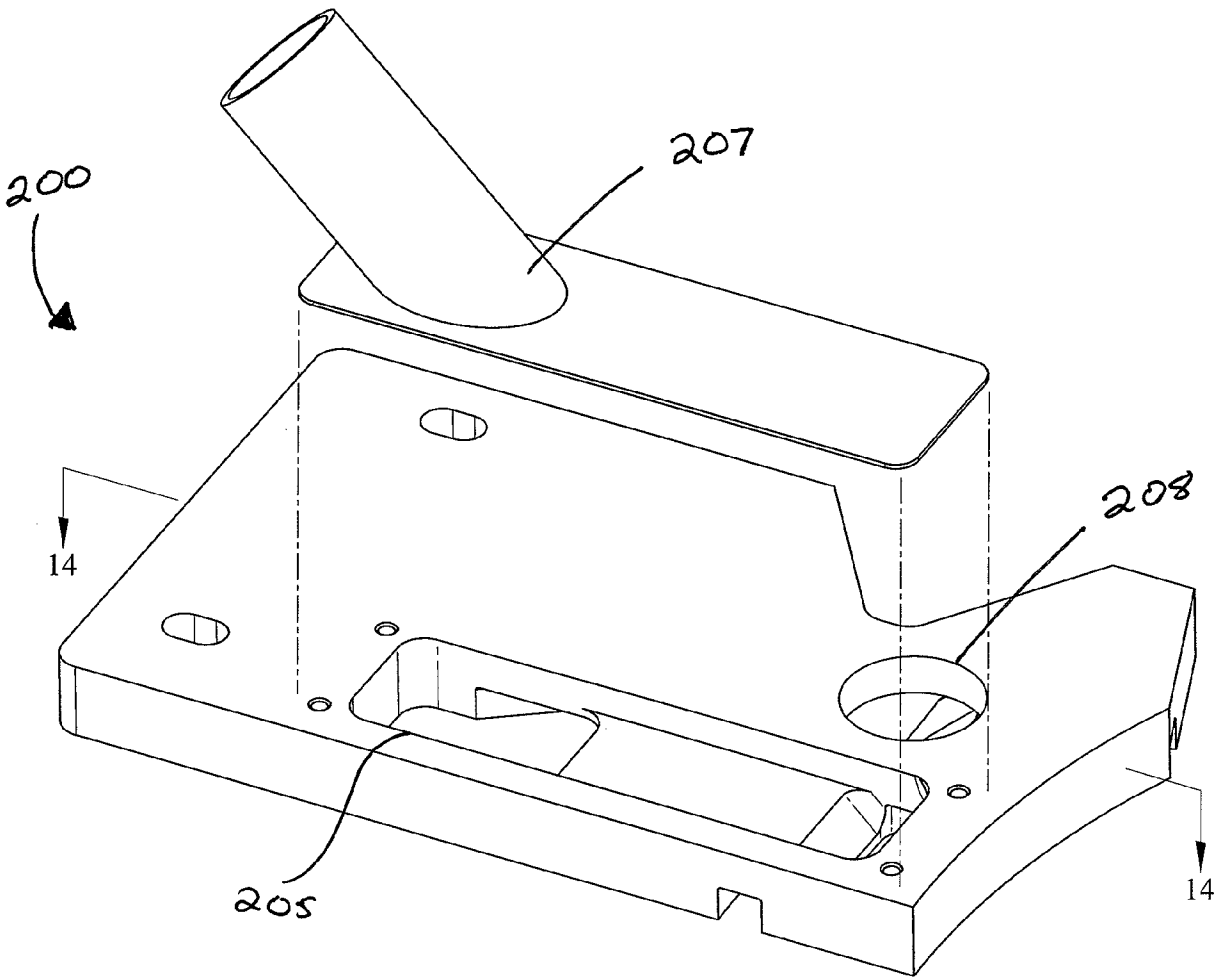
FIG. 13 is a top perspective view of a second embodiment of a die table vacuum assembly with an attachment for a vacuum hose exploded away.
Figure 14:
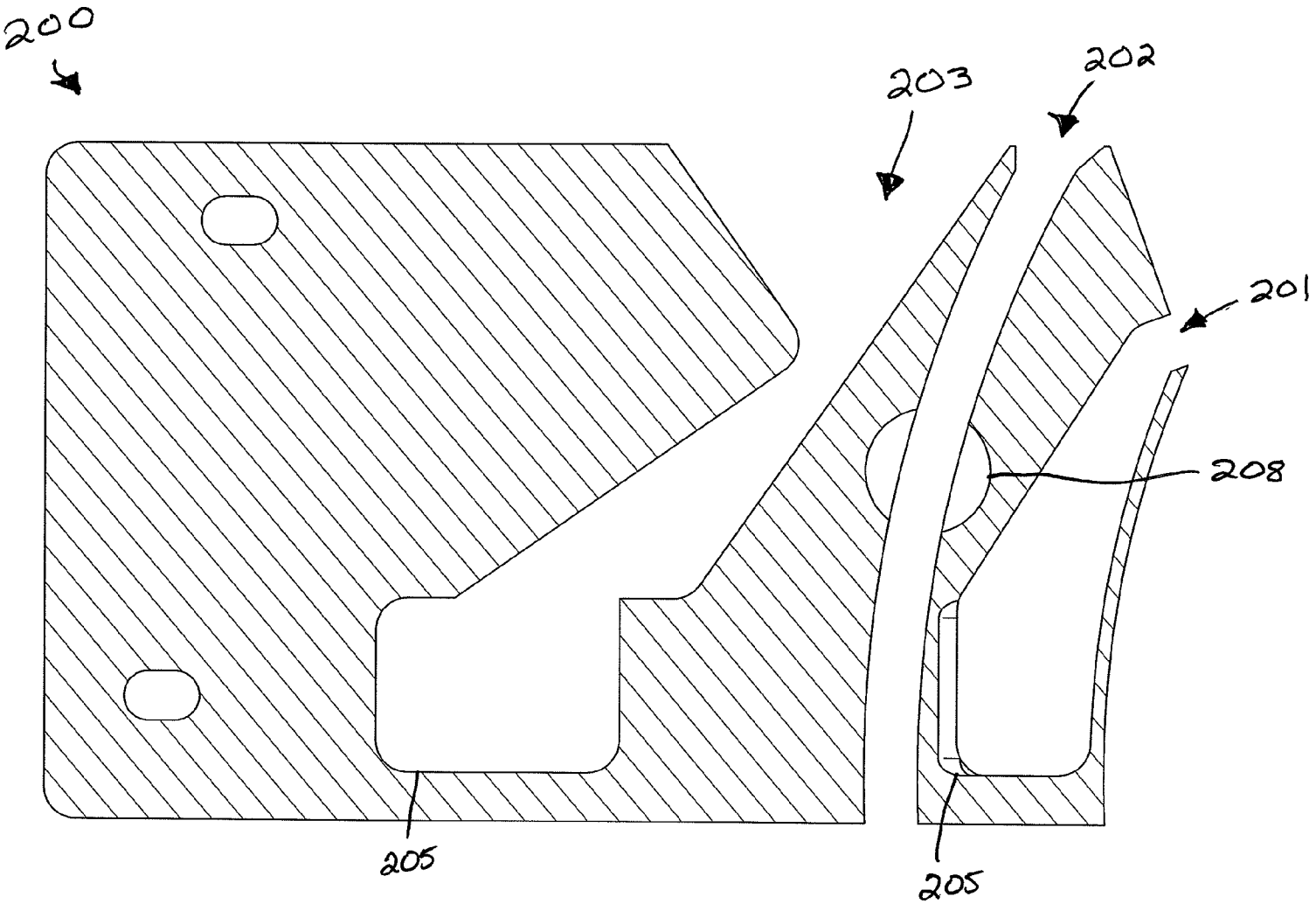
FIG. 14 is a top section view of the second embodiment of the die table vacuum assembly of FIG. 13 taken along the section line 14-14 of FIG. 13.

For example, referring to FIG. 13 and FIG. 14, a second embodiment of a die table vacuum assembly 200 is shown with an attachment for a vacuum hose 207 exploded away. The attachment for a vacuum hose 207 may be coupled to a first die table vacuum port 205 and a vacuum hose may be coupled to the attachment for a vacuum hose 207. The first die table vacuum port 205 is in communication with only a first die table vacuum assembly chamber 201 and a third die table vacuum assembly chamber 203. When die table vacuum assembly is installed adjacent a die table 82, first die table vacuum assembly chamber 201 will be located interiorly of the dies 83 and third die table vacuum assembly chamber 203 will be located exteriorly of the dies.

A second die table vacuum assembly port 208 is in communication with only a second die table vacuum assembly chamber 202. Second die table vacuum assembly port 208 may be coupled to a vacuum hose. When die table vacuum assembly is installed adjacent a die table 82, second die table vacuum assembly chamber 202 will be located over the dies 83. A stronger vacuum may be created at first die table vacuum assembly chamber 201 and third die table vacuum assembly chamber 203 than at second die table vacuum assembly chamber 202. In some embodiments the second die table vacuum assembly chamber 102 may be provided as a separate part distinct from the first vacuum assembly chamber and third die table vacuum assembly chamber. In some embodiments one or more butterfly valves may be implemented to alter vacuum between vacuum assembly chambers 201, 202, and 203.

In some embodiments, the lower punches 90 may be raised by a cam prior to, or simultaneous with reaching vacuum assembly chamber 101. The lower punches 90 may be raised so that the tips of the lower punches are approximately a wire pellet length below the die table 82. Placing the tips of the lower punches 90 approximately a wire pellet length below the die table 82 will allow a single desired wire pellet 3 to remain within the die 83, but will cause any debris or any excess wire pellet 3 that may be present atop the desired wire pellet 3 to be at, near, or above the top surface of the die table 82. Any excess wire pellet 3 or debris atop the desired wire pellet 3 may then be more easily removed by the die table vacuum assembly 100. Placing the tips of the lower punches 90 approximately a wire pellet length below the die table 82 while passing through the vacuum chamber assembly 100 and creating a separate second die table vacuum assembly chamber 102 with lower suction may enable any excess wire pellets 3 or debris to be easily removed without removing desired wire pellets 3.

Referring to FIG. 1, in some embodiments, after passing the die table vacuum assembly 100, and before reaching a formed pellet removal assembly 110, the upper punches 85 and/or lower punches 90 may contact cams that cause the tips of the upper punches 85 and lower punches 90 to move toward one another and compress the wire pellets 3 within the dies 83. The wire pellets 3 may be compressed and formed into a shape by the tips of the upper punches 85 and lower punches 90. The shape may be, for example, a spherical shape. In other embodiments other shapes may be achieved through, for example, appropriate alteration of the tips of the upper punches 85 and/or lower punches 90. In some embodiments pre-compression of the wire pellets 3 may occur prior to the wire pellets 3 being fully compressed and formed into a desired shape.

In some embodiments, after compressing and forming the wire pellets 3 into a desired shape, the upper punches 85 may be raised by a cam out of the dies 83 prior to reaching the formed pellet removal assembly 110. The lower punches 90 may be raised or maintained in position so that the formed wire pellets are at, near, or above the top surface of the die table 82 prior to or simultaneous with reaching the formed pellet removal assembly 110. In some embodiments the lower punches 90 may be raised so that the tips of the lower punches 90 are approximately one sixty-fourth of an inch below the top surface of the die table 82.

Figure 11:
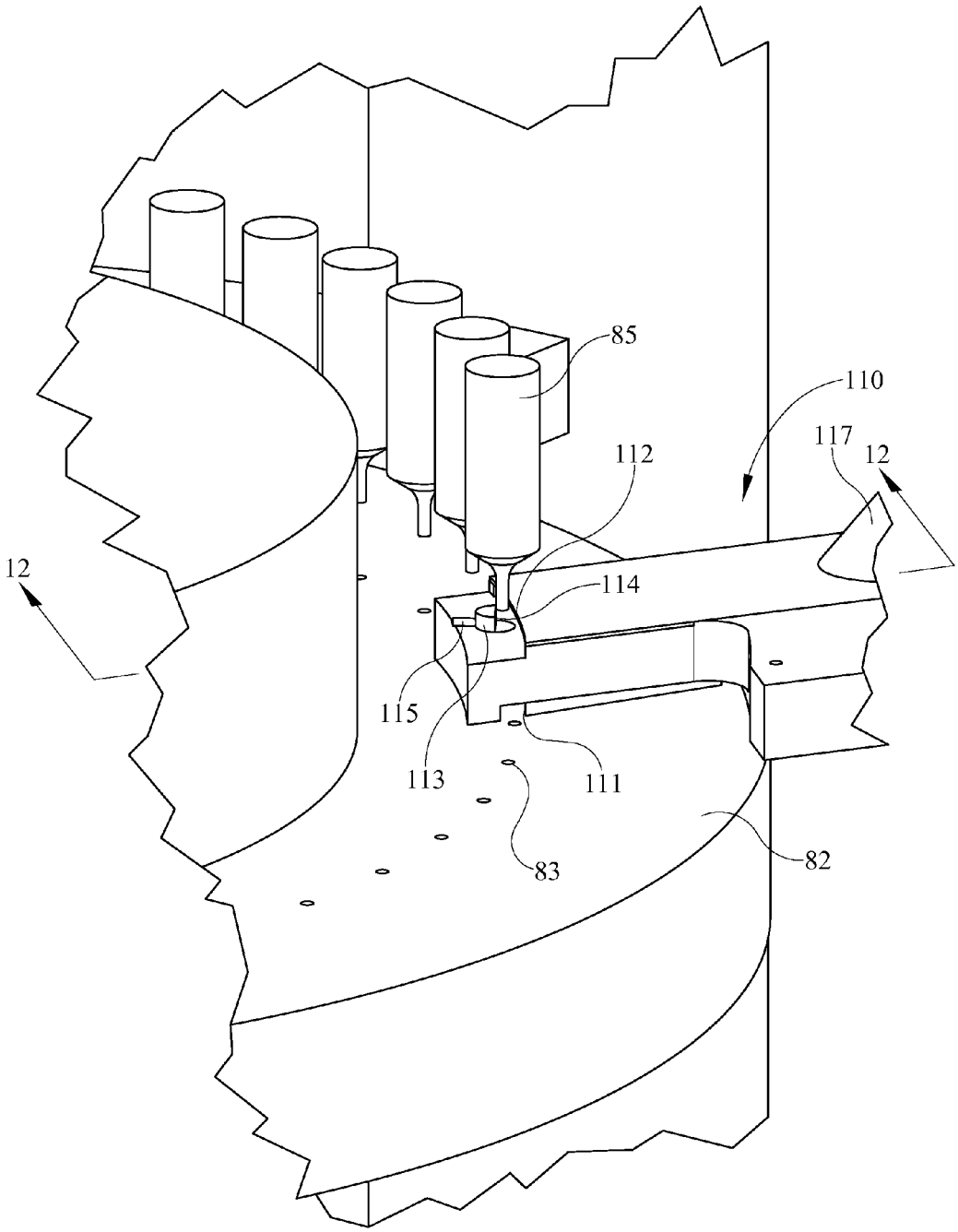
FIG. 11 is a top perspective view of a portion of the embodiment of the system for feeding wire material to a rotary compaction press of FIG. 1 showing a formed pellet removal assembly atop a die table and adjacent a plurality of upper punches.
Figure 12:
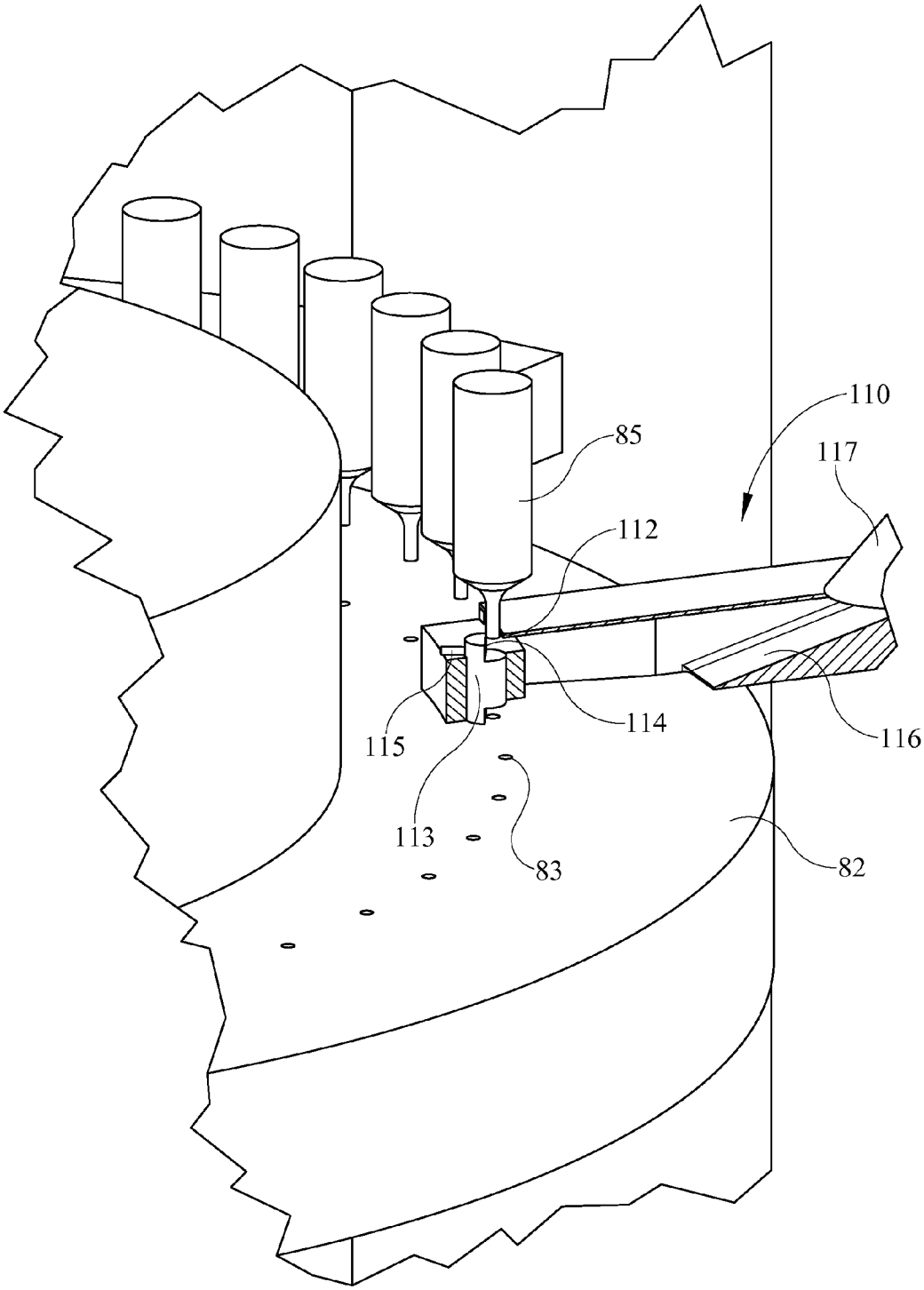
FIG. 12 is a top perspective view of a portion of the embodiment of the system for feeding wire material to a rotary compaction press of FIG. 1 with the formed pellet removal assembly sectioned along the section line 12-12 of FIG. 11 and with a take off pin of the formed pellet removal assembly shown unsectioned.

Referring to FIGS. 11 and 12, the formed pellet removal assembly 110 has a die removal vacuum opening 111 and an upper punch vacuum opening 112. The formed pellet removal assembly has a vacuum port 117 for attachment to a vacuum for creating suction at the die removal vacuum opening 111 and the punch vacuum opening 112. The die removal vacuum port 111 will be aligned with the dies 83 as they pass thereby and will create suction on the dies 83 to remove any formed pellets therefrom. Having the lower punches 90 positioned so that the formed wire pellets are at, near, or above the top surface of the die table 82 may aid in removing the formed pellets. The formed wire pellets may be removed from the dies 83 and pulled through vacuum port 117. The formed wire pellets may proceed up ramp 116 on their way to vacuum port 117. The vacuum port 117 may be coupled to a cyclonic separator in line with a main vacuum line. The cyclonic separator may allow the individual formed wire pellets to drop to a canister below the cyclonic separator and allow the air and any debris to continue through the main vacuum line.

The upper punch vacuum opening 112 will be adjacent the tips of the upper punches 85 as they pass thereby. The upper punch vacuum opening 112 will create suction to remove any formed wire pellets that may stick to the tip of upper punches 85. Take off pin 113 is located adjacent upper punch vacuum opening 112 and has an upper take off area 114. The orientation of take off pin 113 and upper take off area 114 may be adjusted by adjustment handle 115. Take off pin 113 is located immediately below the tips of upper punches 85 as they pass thereby. Upper take off area 114 is adjusted so as to intersect any formed wire pellets that may be stuck to the tip of upper punch 85. Any wire pellets that may be stuck to the tip of upper punch 85 may contact take off area 114 and be directed toward and pulled through upper punch vacuum opening 112. Any formed wire pellets pulled through upper punch vacuum opening 112 will be pulled through vacuum port 117 and collected. A lower take off area of take off pin 113 may also help to remove any formed wire pellets sitting atop dies 83 and direct the formed wire pellets toward vacuum port 117. In some embodiments one or more rotary brushes or rubber flaps may be used in lieu of, or in addition to, take off pin 113 to help remove the formed pellets from the die 83 and/or upper punch 85.

Referring again to FIG. 1 and FIG. 2, an insertion point vacuum 95 has an insertion point vacuum port 96. The insertion point vacuum 95 is generally T shaped and is positioned around the periphery of the wire pellet guide 60 from adjacent the strand of wire insertion point to about half way between the strand of wire insertion point and the wire pellet placement point. The insertion point vacuum 95 has a plurality of vacuum suction apertures adjacent the periphery of the wire pellet guide 60 and helps collect any debris that may be present from the shearing of the strand of wire material 2 or from elsewhere.

In some embodiments one or more laser sensors may be installed on the rotary compaction press. The laser sensors may optionally be in electrical communication with an emergency stop that will stop the rotary compaction press. The laser sensors may monitor, for example, the die table 82 immediately before pre-compression of wire pellets 3 to detect excessive material protruding from the dies 83, the dies 83 after the formed wire pellets have been removed to detect any unremoved formed wire pellet that may still be remaining in dies 83, and the tips of the upper punches 85 immediately after the formed wire pellets have been removed to detect a formed wire pellet that may still be adhering to the tip of the upper punch 85.

In some embodiments the rotary compaction press may be an Elizabeth-Hata Rotary Press, Model Number HT-AP44-MSU-C. Different rotary compaction presses may be used however, including, for example, custom rotary presses, rotary presses made for pharmaceuticals manufacturing, and rotary compaction presses not made for pharmaceuticals manufacturing. In some embodiments the rotary compaction press may be a rotary compaction press having one or more parts designed for forming wire pellets. For example, the punch tip of the upper punches and/or lower punches could be made shorter than punch tips sometimes employed in rotary compaction presses. Also, for example, the cup geometry, land width, and/or blend radius of the forming portion of the upper punches and/or lower punches may be different than punch tips sometimes employed in rotary compaction presses. Also, for example, the overload system could be lightened. Also, for example, a greater or lesser number of dies may be used. Also, for example, the upper cam track and/or lower may be sealed and pressurized in order to keep any contaminants from entering the upper cam track and/or lower cam track.

While several inventive embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the inventive embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the inventive teachings is/are used. Those skilled in the art will recognize, or be able to ascertain using no more than routine experimentation, many equivalents to the specific inventive embodiments described herein. It is, therefore, to be understood that the foregoing embodiments are presented by way of example only and that, within the scope of the appended claims and equivalents thereto, inventive embodiments may be practiced otherwise than as specifically described and claimed. Inventive embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the inventive scope of the present disclosure.

All definitions, as defined and used herein, should be understood to control over dictionary definitions, definitions in documents incorporated by reference, and/or ordinary meanings of the defined terms.

The indefinite articles "a" and "an," as used herein in the specification and in the claims, unless clearly indicated to the contrary, should be understood to mean "at least one."

The phrase "and/or," as used herein in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of" "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

It should also be understood that, unless clearly indicated to the contrary, in any methods claimed herein that include more than one step or act, the order of the steps or acts of the method is not necessarily limited to the order in which the steps or acts of the method are recited.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures, Section 2111.03.

We claim:

1. A rotary compaction press having a wire feed system, the rotary compaction press comprising:

a wire exit aperture;

a cutting disc adjacent said wire exit aperture, said cutting disc having a plurality of annularly arranged wire cutting surfaces and having a plurality of wire notches, said cutting surfaces and said wire notches in fixed positional relation to one another and configured in joint rotatable relationship about a common axis;

wherein said cutting disc is rotatable, thereby causing said wire cutting surfaces to sequentially pass over said wire exit aperture;

a rotatable die table having a plurality of dies below said cutting disc, wherein one of said plurality of dies is selectively coaxially aligned with one of said notches of said cutting disc;

a wire pellet placement location wherein one of said notches of said cutting disc and one of said dies of said die table are selectively correspondingly coaxially aligned with one another.

2. The rotary compaction press of claim 1 further comprising a tamp above said cutting disc, said tamp having a tamping area selectively axially aligned with one of said notches of said cutting disc and axially aligned with one of said plurality of dies of said die table at said wire pellet placement location.

3. The rotary compaction press of claim 2 wherein said tamp area is actuable, movable from a proximal position adjacent said cutting disc and one of said notches when one of said notches passes thereby and is coaxially aligned with one of said dies to a distal position farther away from said cutting disc than said proximal position is from said cutting disc.

4. The rotary compaction press of claim 1 further comprising a coil spring coupled between said wire exit aperture and a wire feeder structure.

5. The rotary compaction press of claim 1 further comprising a wire stop coaxially aligned with said wire exit aperture on an opposite side of said cutting disc than said wire exit aperture.

6. The rotary compaction press of claim 5 wherein said wire stop is automatically selectively axially adjustable.

7. The rotary compaction press of claim 1 wherein said notches and said cutting surfaces are positioned along the periphery of said cutting disc.

8. The rotary compaction press of claim 1 further comprising a plurality of tamping cams on said cutting disc, wherein rotation of said cutting disc causes said tamping cams to repeatedly actuate a tamping area between a first position and a second position.

9. A rotary compaction press, comprising:

an exit aperture configured to pass a strand of material therethrough;

a cutting disc positioned adjacent said exit aperture, said cutting disc having a plurality of annularly arranged cutting surface and notch pairs;

wherein said cutting disc is rotatable about an axis, thereby causing said cutting surface and notch pairs to rotate in unison about said axis and sequentially pass said exit aperture;

a rotatable die table having a plurality of dies, wherein at least one aligned die of said plurality of dies is selectively coaxially aligned with at least one aligned notch of said notches of said cutting disc when said cutting disc and said rotatable die are both rotating;

at least one tamping area, wherein said tamping area is substantially axially aligned with said aligned die and said aligned notch when said aligned die and said aligned notch are coaxially aligned; and wherein said tamping area substantially covers said aligned notch when said aligned notch and said aligned die are coaxially aligned.

10. The rotary compaction press of claim 9, wherein said at least one tamping area is actuable between at least a proximal position when said aligned die and said aligned notch are coaxially aligned and a distal position that is farther away from said aligned notch than said proximal position is from said aligned notch.

11. The rotary compaction press of claim 9, further comprising a spring in communication with said exit aperture, said spring configured to pass said strand of material therethrough to said exit aperture.

12. The rotary compaction press of claim 9, further comprising a stop coaxially aligned with said exit aperture.

13. The rotary compaction press of claim 12 wherein said stop is positioned on a side of said cutting disc that is opposite said exit aperture.

14. The rotary compaction press of claim 13 wherein said stop is selectively axially adjustable, thereby altering the distance between said exit aperture and said stop.

15. The rotary compaction press of claim 10, further comprising a plurality of tamping cams on said cutting disc, wherein rotation of said cutting disc causes said tamping cams to repeatedly actuate said at least one tamping area between said proximal position and said distal position.

16. The rotary compaction press of claim 9 wherein said cutting surfaces are positioned along the periphery of said cutting disc.

17. A rotary compaction press comprising:

an exit aperture configured to pass a strand of material therethrough;

a cutting disc adjacent said exit aperture, said cutting disc having a plurality of annularly arranged cutting surfaces and adjacent notches, said cutting surfaces and adjacent notches rotating jointly in unison around an entire circumferential path about a common axis;

a stop coaxially aligned with said exit aperture;

wherein said cutting disc is rotatable about said common axis, said exit aperture disposed at a radial distance from said axis thereby causing said cutting surfaces and adjacent notches rotating around said entire circumferential path to sequentially pass said exit aperture;

a rotatable die table having a plurality of dies below said cutting disc, wherein one of said plurality of dies is selectively coaxially aligned with one of said notches of said cutting disc;

a pellet placement location wherein an aligned notch of said notches of said cutting disc and an aligned die of said dies of said die table are selectively correspondingly coaxially aligned with one another; and at least one tamping area substantially axially aligned with said aligned die and said aligned notch at said pellet placement location.

18. The rotary compaction press of claim 17, wherein said tamping area is actuable between at least a first position and a second position.

19. The rotary compaction press of claim 18, further comprising a plurality of tamping cams on said cutting disc, wherein rotation of said cutting disc causes said tamping cams to repeatedly actuate said tamping area between said first position and said second position.

20. The rotary compaction press of claim 17, wherein said strand of material is a wire strand of material.

21. The rotary compaction press of claim 20, wherein said wire strand of material comprises at least one of a tungsten-polymer composite and lead.

* * * * *